United States Patent [19]
Lafourcade

[11] 4,278,251
[45] Jul. 14, 1981

[54] RACKET FRAME FOR BALL GAMES

[76] Inventor: Paul Lafourcade, 23, rue de la Paix, 65 600 Semeac, France

[21] Appl. No.: 17,631

[22] Filed: Mar. 5, 1979

Related U.S. Application Data

[63] Continuation of Ser. No. 793,554, Apr. 4, 1977, abandoned.

[30] Foreign Application Priority Data

May 5, 1976 [FR] France ..... 76 13881
Sep. 30, 1976 [FR] France ..... 76 29987
Mar. 1, 1977 [FR] France ..... 77 06548

[51] Int. Cl.[3] ..... A63B 49/12; A63B 49/08
[52] U.S. Cl. ..... 273/73 G; 273/73 C; 273/73 H; 273/73 J
[58] Field of Search ..... 273/73 R, 73 C, 73 D, 273/73 F, 73 G, 73 H, 73 J

[56] References Cited

U.S. PATENT DOCUMENTS

| | | | |
|---|---|---|---|
| 1,541,828 | 6/1925 | Larned | 273/73 H |
| 3,487,518 | 1/1970 | Hopfeld | 273/73 C X |
| 3,582,072 | 6/1971 | Stueck | 273/73 J |
| 3,582,073 | 6/1971 | Melnick et al. | 273/73 J X |
| 3,625,512 | 12/1971 | Latham et al. | 273/73 H X |
| 3,633,910 | 1/1972 | Spenle | 273/73 H X |
| 3,642,283 | 2/1972 | Wilkens | 273/73 H X |
| 3,840,230 | 10/1974 | Schaefer et al. | 273/73 J X |
| 3,879,036 | 4/1975 | Portz et al. | 273/73 J |
| 3,884,467 | 5/1975 | Sommer | 273/73 H X |
| 3,949,988 | 4/1976 | Staufer | 273/73 F |
| 3,972,529 | 8/1976 | McNeil | 273/73 H X |
| 3,975,017 | 8/1976 | Galich | 273/73 H |
| 3,990,701 | 11/1976 | Kim | 273/73 G X |
| 3,998,457 | 12/1976 | Dempsey et al. | 273/73 C |
| 4,045,025 | 8/1977 | Staub et al. | 273/73 F |
| 4,177,990 | 12/1979 | Kajiwara | 273/73 C |
| 4,181,301 | 1/1980 | Serpoud | 273/73 C |

FOREIGN PATENT DOCUMENTS

| | | | |
|---|---|---|---|
| 2106800 | 9/1971 | Fed. Rep. of Germany | 273/73 H |
| 2224316 | 11/1973 | Fed. Rep. of Germany | 273/73 H |

*Primary Examiner*—Richard J. Apley
*Attorney, Agent, or Firm*—Sandler & Greenblum

[57] ABSTRACT

A racket frame for ball games, such as a tennis racket frame, is made out of a length of material shaped into a loop to form a generally round head and two parallel longitudinal branches forming a portion of a racket handle. The length of material comprises a hollow beam having a cavity of generally rectangular cross-section. The cavity is bounded by flanges and webs of the beam which are shaped so as receive and cooperate with additional elements. The frame has a central bow having a longitudinal internal channel in communication with the internal cavity of the length of material and molded material extends through the cavity of the beam and into the channel of the central bow. The racket frame possesses good mechanical qualities and results in satisfactory playing performance.

20 Claims, 11 Drawing Figures

RACKET FRAME FOR BALL GAMES

This is a continuation of application 793,554, filed May 4, 1977, now abandoned.

Priority of French Applications 7613881, filed May 5, 1976, 7629987, filed Sept. 30, 1976, and 7706548, filed Mar. 1, 1977, is claimed.

BACKGROUND OF THE INVENTION

The subject matter of the present invention generally relates to a racket frame for ball games, e.g. a tennis racket frame.

SUMMARY OF THE INVENTION

The invention provides a frame of the type mentioned above from a section of material, e.g. made of extruded metal, which is shaped into a loop to form a rounded head which has two branches forming the frame of the handle.

The invention aims at obtaining, with a minimum number of manufacturing operation, an excellent quality frame which combines the advantages of the metal section, both in regard to manufacture and strength, with the advantages of synthetic materials e.g. synthetic fibers and/or resins, in regard to weight reduction and play qualities.

The invention furthermore aims at providing a racket frame for ball games in which the association of the section with the synthetic material(s) is easy to achieve and durable, which reduces the number of manufacturing operations and the cost of the product.

To this end, the racket frame for ball games according to the invention, made from a section shaped into a loop to form the rounded head and having two longitudinal parallel branches forming the frame of the gripping handle, includes the following features:

the section is hollowed out to form a hollow compartment or hollow beam of rectangular cross-section, positioned edgewise, the thickness of the walls of the hollow compartment is greater in some longitudinal areas then in others, the flanges and/or webs of the hollow compartment are shaped to receive and cooperate with added elements, thereby improving the mechanical characteristics of the frame, to complete the rounded head, the frame is fitted with a central bow provided with an internal longitudinal channel which communicates with the internal cavity of the section, and a material is moulded into both the cavity of the section and into the channel or cavity of the central bow.

In a preferred form of the invention, the surface of the flanges comprises a longitudinal groove whose edges are recessed, said groove receiving additional material in the form of synthetic fibers and/or resins held in position by the recesses.

Carbon fibers or glass fibers are preferably used, the effect of which is to produce rackets possessing excellent mechanical qualities of torsional and bending strength, these qualities already having been provided by the shaping of the section into a rectangular-section hollow beam; the shaping of the webs and flanges with recessed grooves facilitates the addition of fibres.

Moreover, molding a synthetic product into the section and the central bow contributes greatly to eliminating the vibrations which so frequently in metal rackets at the time of impact, this molding being facilitated by the shaping of the section.

BRIEF DESCRIPTION OF THE DRAWINGS

Other advantages and characteristics of the invention wil emerge from a reading of the following description of the invention, which is given by way of non-limiting example and which is illustrated by the attached drawings, in which.

DETAILED DESCRIPTION OF THE DRAWINGS

Figure 1:
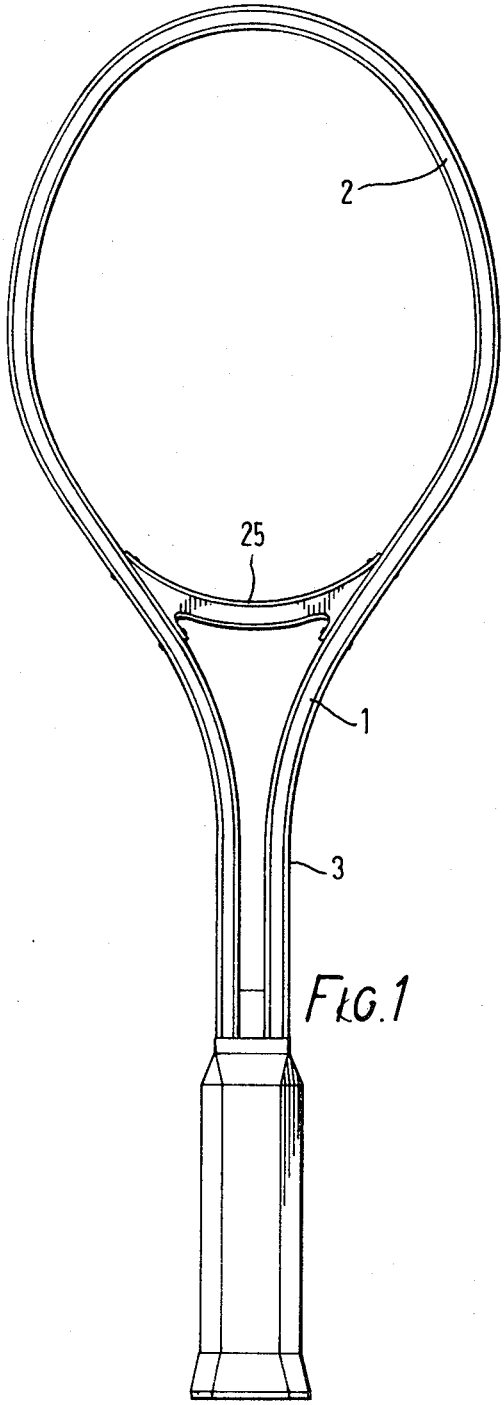
FIG. 1 shows an elevational view of a racket frame formed according to the invention.
Figure 2:
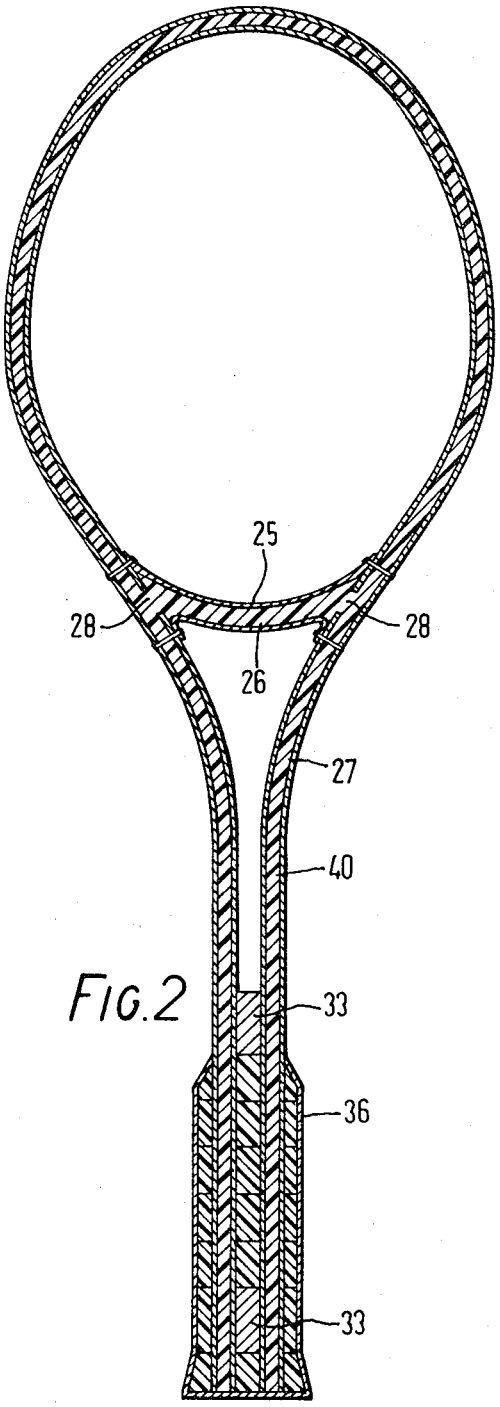
FIG. 2 shows longitudinal section of the racket frame of FIG. 1, FIGS. 3, 4, 5 and 6 show sectional views of the difference sections which can be used to form the racket frame.

As shown of FIGS. 1 and 2, the frame for a racket for ball games according to the invention is made from a section 1 in a ductile material produced by extrusion or drawing, preferably the material being but not limited to metal, e.g. ZYKRAL, which is shaped into a loop to form the rounded head 2 and the downwardly extending parallel branches 3 of the handle. The round head has an open bottom portion with opposed openings 28 positioned adjacent to this open bottom portion.

Figure 3:
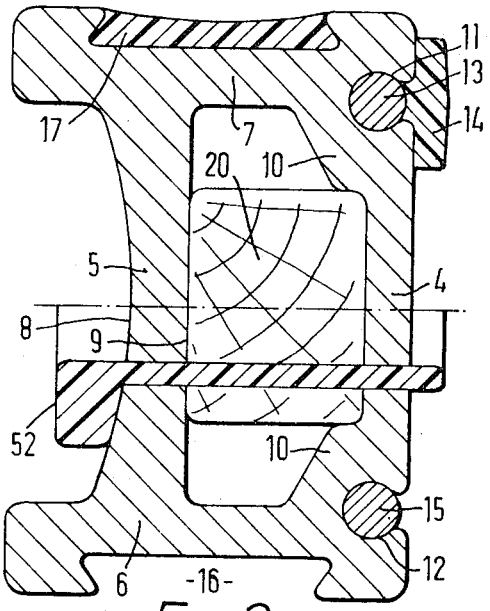
Figure 5:
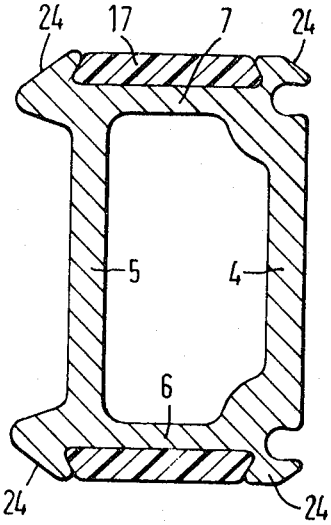

As shown in the sectional views in FIGS. 3, 5 and 5, the section from which the racket frame according to the invention is made is hollowed out into a closed compartment cavity or hollow beam having two parallel vertical webs 4 and 5 and two flanges 6 and 7. The section, when it is being shaped to form the rounded head and the parallel branches of the handle, not shown in order, to simplify the description, is positioned edgewise, its section being substantially rectangular. A string supporting grommet 52 is provided which extends through webs 4 and 5. The section which forms the rounded head and parallel branches of the handle preferably comprises a one-piece unit.

The web 5 which is on the outside of the frame is set back or inwardly from the outside edge of flanges 6 and 7 to which it is fixed, and the web an outer face 8 which is curved towards its transverse median axis and a flat inner face 9 which, in addition to advantageously forming a housing for the strings and the cylindrical sheaths notably, makes it possible to increase its resistance to the pull exerted by the strings on the outside face during play.

The internal web 4 of the frame after forming is joined to flanges 6 and 7 by two longitudinal gussets 10 made by extrusion, which stiffen the entire the beam to increase its torsional and bending strength.

According to the invention, the webs and flanges of the hollow beam, cavity or compartment such as described hereinabove are shaped so as to receive, retain and cooperate with fixed and/or removable components which help to increase the rigidity of the frame, notably in the head, and to regulate its weight, center of gravity and inertia torque characteristics, for example.

The face of the web 4 on the inside of the head is provided, on either side of its longitudinal median axis and also facing the wall of each flange 6, 7 or gusset 10, with a groove 11 and a longitudinal and parallel groove 12 which extend all around the head of the racket.

The grooves 11 and 12 are substantially circular in cross-section, their depth nevertheless being greater than the diameter of the circle formed as they are recessed, the distance between their lips being smaller than the diameter of the circle formed.

Each of these recessed grooves can receive an element which fits into it by pushing so as to create an interlock relationship.

To this end the element has a longitudinal rounded element or tongue 13 with part of it substantially cylindrical, the diameter of which is at least equal to that of the circle formed.

The tongue 13 serves as a means of fixing a longitudinal cap 14 which fits on to the surface of the web 4 and helps to regulate the weight and the center of gravity, the element being capable of being housed by the tongue around its whole inside periphery of the frame, or on certain portions of said periphery.

The element can be made of any metal or other material which is sufficiently rigid. It is also conceivable that the element could consist of a metal wire 15, e.g. titanium, of a diameter such as has been described as suitable, as shown in each of FIGS. 3 and 4 by way of example. This arrangement of the invention makes it possible, in addition to the regulation of the weight and center of gravity of the racket; by forcing in the element and holding then in position in the grooves by force, to pre-stress the hollow beam or compartment, which considerably increases its rigidity.

Figure 4:
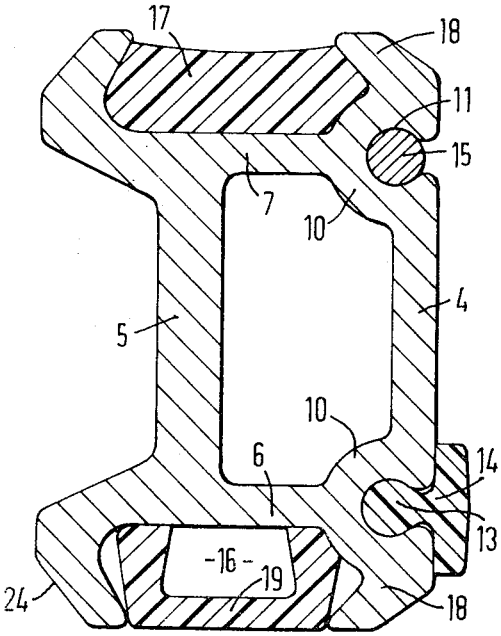

Each of the flanges 6 and 7 of the section, as shown in FIG. 3 and FIG. 4, has a longitudinal recessed cavity 16. As shown, this cavity receives a filling 17 of a composite resin-glass fibre material and/or carbon alone, preferably positoned lengthwise, said material being held in position by the recess after hot polymerization. It is obvious that this filling 17, basicaly intended to increase the rigidity of the frame and its bending strength, will preferably be provided on rackets at the top end of the price range, it being possible to provide filling of other less expensive materials for rackets at the lower end of the price range.

As shown in FIG. 4, the section forming the racket frame according to the invention has substantially the same characteristics as the section previously described. It differs from the section shown in FIG. 3, however, in that the grooves 11 and 12 are made facing the walls of flanges 6 and 7 respectively, and in that the stiffening gussets 10 are shaped in an arc of a circle which extends to the corresponding wings 18 of the flanges 6 and 7.

The wings 18 of the flanges slant towards the longitudinal median axis of the flanges to form the longitudinal cavity 13 as described, the height of said wings being, however, sufficient for the depth of this cavity to be of the order of a few millimeters.

The cavity 16 can, as described above and as shown in FIG. 3 for flange 7, receive a filling of an added material made of resin-carbon fiber. It can equally receive, notably in the case of rackets at the lower end of the price range, a removable added material consisting, for example (FIG. 4) of a section 19 made of synthetic material, e.g. RILSAN, which has a recessed shape the reverse of that of cavity 16 and which fits into it and is kept there by force, said section enabling the racket's weight characteristics to be modified.

It is possible that one of the added elements can be used alone or combined with others, for example the longitudinal element housed in the grooves with the carbon fiber filling the flanges or the section slotted by force into said longitudinal cavity in the flanges.

As shown in FIG. 3, a longitudinal filling body 20 can be inserted into the hollowed-out compartment where it will be held between the gussets 10, this body comprising, e.g. a stick of a light material such as resin-impregnated balsa wood.

Figure 6:
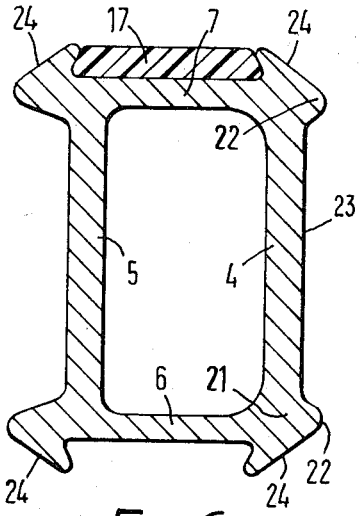

FIG. 6 shows another embodiment of the invention notably with respect to the section used, having an outside web 5 fixed and set back from the edges of flanges 6 and 7 and which provides a housing for the cylindrical sheaths, and which has a thickness substantially greater than that of the inside web 4 to enable it to withstand the tensile stresses exerted by the string when the ball is hit, the loops of string resting on its outside face through transverse holes in said frame.

The inside web 4 is fixed to the end of flanges 6 and 7 and its thickness is increased at each of its ends 21 at the anchorage points so as also to be able to prevent any deformations and tears in the material of the section created when it is bent for shaping.

Each end of the web 4 has a longitudinal boss 22 parallel to the axis of the section which forms a cavity 23. Preferably, the bosses are transversely pyramidal in shape, their respective tops being situated substantially at the extensions of flanges 6 and 7 opposite to and substantially in alignment with said flanges.

Figure 7:
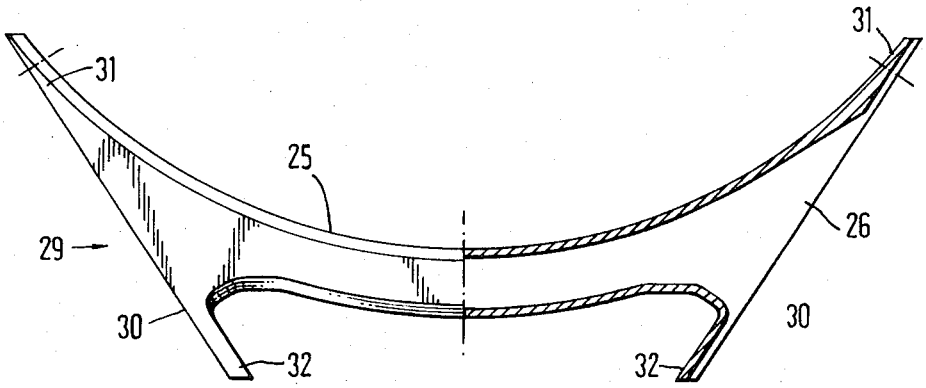
FIG. 7 shows one type of central bow designed to complete the rounded head.
Figure 8:
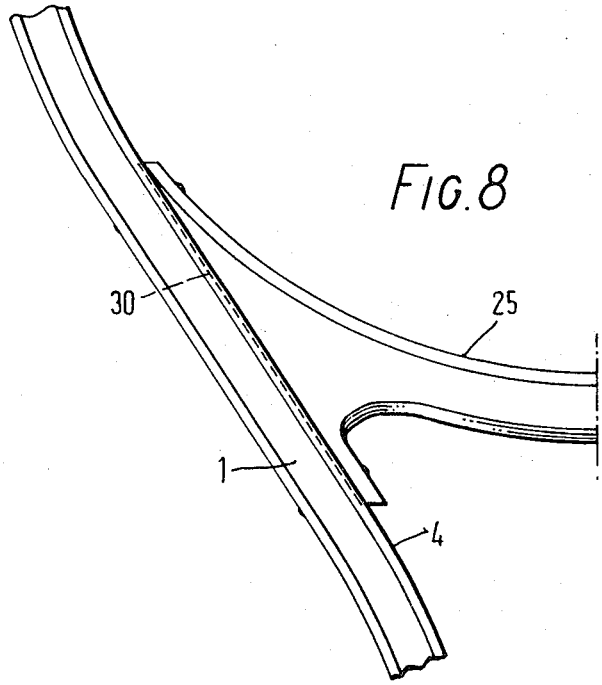
FIG. 8 shows the cooperation of the section and a central bow according to FIG. 7, FIGS. 9 and 10 show different types of braces and collars used according to the type of section used.

In each of the types of sections shown, the edges of the flanges which constitute the leading edges of the frame are preferably provided with a bevelled edge 24 whose effect is to reduce the resistance of the frame to air. After the section has been shaped into a loop, and before the addition of the fiber as described, the head of the frame is completed by a central bow 25 as shown in FIGS. 7 and 8. The central bow consists of a one-piece unit, preferably a light alloy casting which hollowed out on the inside into a longitudinal channel 26 whhich communicates with the internal cavity 27 of the section forming the frame by two openings 28 (FIG. 2) opposite said channel made in the web 4 on the inside of the section of the frame on either side of the central bow. The opposing openings 28 cooperate with the openings at the ends of the bow channel to receive a continuous molded material therein.

The central bow is provided at each of its ends with two inside surfaces 29 on to which its cavity or channel 26 opens, and which rest against the web of the section.

Two parallel longitudinal ribs 30 situated on the longitudinal edges of each of the surfaces 29 and perpendicular to said surfaces are positioned, at the time of assembly which is done by riveting, into the parallel longitudinal grooves 11 and 12 of the edge of the web 4 of the inside section of the frame, to form a longitudinal joint between the section and the bow at the neutral surface, thus the point from its neutral surface, thus the most subject to torsional stresses.

In cross-section, the central bow is substantially a hollow beam with four sides formed by two sets of parallel surfaces 31 and 32 which respectively brace the flanges 6 and 7 and the webs 4 and 5 of the section which forms the frame.

It can be understood that because of its characteristics, the central bow enables a particularly effective joint to the section to be made without superfluous weight, since it is lightened by its central cavity without reducing its strength.

Figure 9:
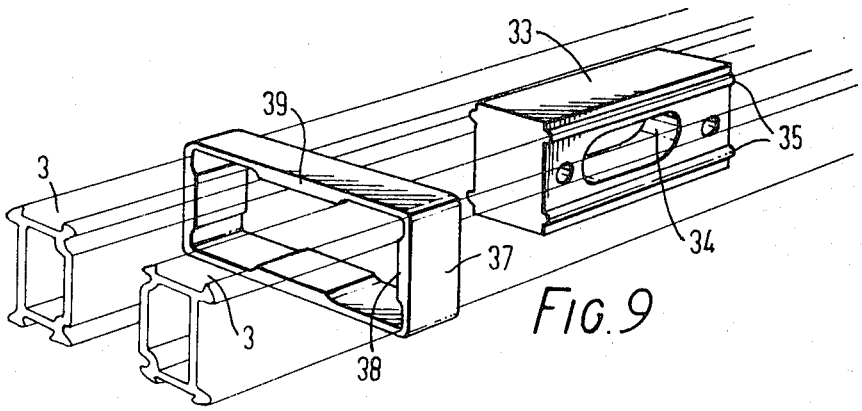
Figure 10:
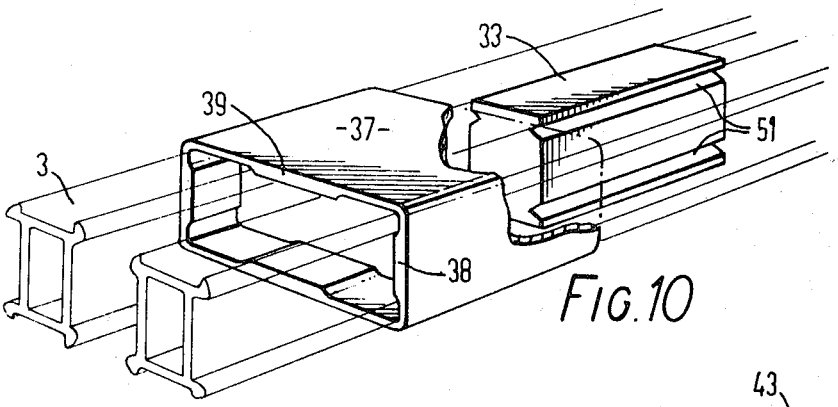

Between the parallel branches 3 designed to form the handle, braces 33 are placed, as shown in FIGS. 9 and 10, which are designed to keep the branches apart in cooperation with the central bow 25, as well as to prevent twisting of the branches.

The braces consist of a rectangular parallelipiped made of synthetic material posiitoned edgewise and provided with cavities 34 designed to make it lighter.

The sides of said braces include two parallel ribs 35 designed to penetrate into the two corresponding grooves 11 and 12, as described above, of web 4 of the section.

The transverse cross-section of the ribs of the braces is larger than that of the grooves which are recessed so as to hold them in said grooves.

Provision is made, as shown in FIG. 2, to fit two braces: the first above the top level of the rigid longitudinal shell 36 which forms the gripping handle and inside which the parallel branches 3 of the section are inserted; and the other inside said shell.

A collar 37, as shown in FIGS. 9 and 10 is substantially rectangular in shape and has on the inside wall of each of its short sides a rib 38 fitting into the housing in the outside web 5 of each of the branches of the section and a rib 39 on its longest side which fits in between the flanges of said branches and is slotted by force onto the joined branches and against the braces of the section until the ribs 39 butt under and against the top brace at the top of the handle; preferably this collar is made of a synthetic material with a suitable grade of mechanical strength.

It has been shown during tests carried out that the cooperation of the brace and the collar after the branches of the frame have been inserted into the handle provides sufficient strength at the place where said branches are joined.

However, in order to make this coupling even stronger, it is possible, after having made a transverse perforation in the branches of the section level with the brace, to fix them with a rivet.

A synthetic material, for example a polyurethane or a material which may include fibers is injected into the cavity of the profile which it fills, also penetrating into the cavity 26 or channel of the central bow or through the openings 28 made in the web 4 of the section, this material being preferably of low density.

The effect of this material is to suppress vibrations, to have a damping effect and to increase the strength of the section of the central bow as well as the effectiveness of the latter's joint to the section.

The gripping handle fitted on to the branches as described and previously braced consists of a hollow rigid shell 36 with a rectangular opening 41 at its top end and closed at its bottom end.

The rectangular opening 41 corresponds to the dimensions of the branches of the section assembled on braces.

The shell forming the handle is preferably made of a single moulded piece; however, it is conceivable that it could be made of two half-shells fitted edge to edge and glued.

The transverse cross-section of the shell is preferably octagonal and irregular, two larger faces coming on either side of flanges 6 and 7 of the branches 3 of the section.

The shell as described has at its bottom end an enlarged part 44.

Figure 11:
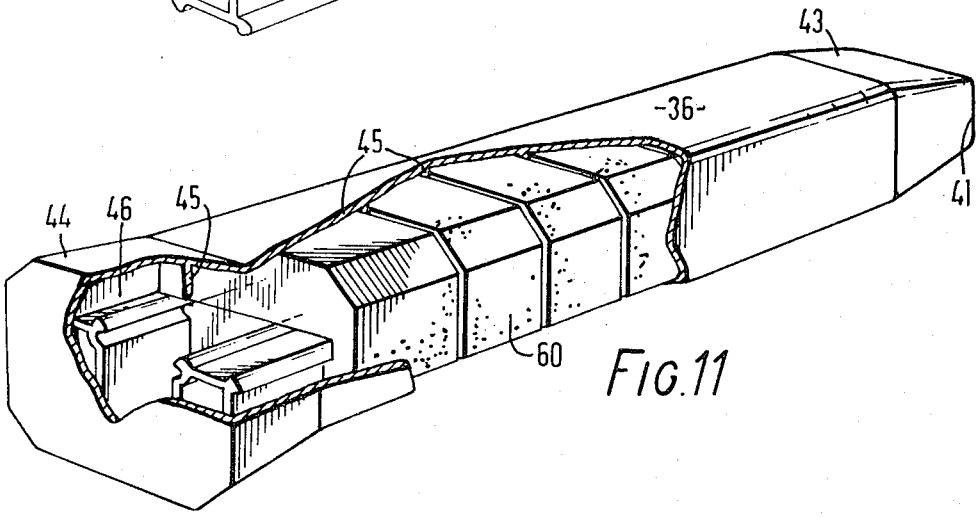
FIG. 11 shows a partially cut-away view of a gripping handle for the racket frame.

Its inside walls are provided on either side of its transverse median axis with vertical ribs 45 projecting towards said frame which rest against the flanges 6 and 7 of the branches of the section and at its base in the enlarged part there are molded walls 46 or longitudinal stops which hold the ends of said branches. After positioning the handle as described and butting its top end against the collar cooperating with the brace, a low density synthetic material 40 of the same kind as that which is injected into the cavity of the section and into the channel of the central bow is injected into the rigid shell through an opening in its wall as shown in FIG. 11.

The synthetic material fills up the rigid shell and in conjunction with its edges holds said shell on the branches 3 of the section, fixing it permanently without screws or other means of joining, and eliminating vibrations in the handle.

This arrangement of the invention produces a racket which is very pleasant to grip and hold in the hand, with pressures distributed throughout the section inside said shell.

After the frame has been made as described, the head and the central bow will be pierced transversely and will receive the cylindrical sheaths and the stringing which is done in a standard manner.

Because of the reduced number of processes, the industrial manufacture of the frame according to the invention is easy and allows high production rates.

According to another form of embodiment of the invention, not shown, th central bow 6 consists of a molding with a concave wall completing the head and two slanting side walls resting against the web 4 of the section.

The bow is preferably made of a synthetic material which may be filled with fibres and molded, said bow having openings made by molding for th strings to pass through, said openings made on the branches being conical to facilitate stringing.

The material used to make the bow is such that, although rigid, its branches are able to bend very slightly to follow the distortion of the frame when the ball is hit, which ensures durability of the joint between the head and the bow and prevents the section from breaking at this point. To make the racket lighter end to improve its appearance, each side face of the central bow has a cavity.

The longitudinal edges of each of the bearer surfaces have a bevelled edge.

The bevelled edges enable the surfaces to rest against the web 4 and to center the bow so that it rests against the surface of a boss 22, that is to say a the farthest points from the neutral surface of the beam formed by the section.

According to another form of embodiment of the invention, not shown, the slanting surfaces completely overlap the section and they are provided with grooves which receive the bosses of said section.

Each of the bearer surfaces of the bow has at least one nipple projecting perpendicularly, which during assembly is inserted into a hole in the web 4 of the section, which facilitates its positioning and fixing with screws. One screw is provided for at the top and end one at the bottom end of each of the bearer surfaces.

Preferably a nipple is pierced by a longitudinal channel which serves as a housing for the corresponding screw, which avoids the latter coming in contact with the web 4 of the section and vibrations.

After fixing the central bow, the branches 3 receive two braces 33, one of which is substantially at their ends and one two-thirds of the way along the frame of the racket.

The braces, parallelepiped in shape, have on each of their sides two longitudinal grooves 51 which receive the bosses 22 in such a way that the braces overlap the section.

The top brace cooperates with a collar 37 sliding on branches 3 of the frame so as to hold said brace. After reassembly of the frame as described and hot polymerization of the resins and fibers, the frame will be pierced for subsequent stringing and will receive the desired decoration.

The invention enables excellent quality, very strong racket frames to be obtained with a minimum of industrial operations.

The invention is not limited to the embodiments described above, but on the contrary covers all variants.

I claim:

1. A racket frame comprising:

(a) a generally round head having an open bottom portion and opposed openings positioned adjacent to said bottom portion;

(b) two parallel longitudinal branches extending downwardly from said head and forming a portion of a racket handle, said head and said branches being a one-piece unit comprising a hollow beam having a cavity of generally rectangular cross section with opposed webs and opposed flanges;

(c) a central bow attached to said head for closing said open bottom portion, said bow being a one-piece unit comprising a longitudinal channel having openings at its ends, said channel openings cooperating with said opposed openings; and (d) a molded material extending through said cavity, said channel and all of said cooperating openings.

2. A racket frame in accordance with claim 1 wherein said hollow beam comprises walls which do not have a uniform thickness.

3. A racket frame in accordance with claim 1 wherein said flanges and webs are shaped to receive and securely retain additional elements for improving the characteristics of the frame.

4. A racket frame in accordance with claim 3 wherein each of said flanges has a longitudinal recessed groove into which an additional element is placed.

5. A racket frame in accordance with claim 4 wherein said additional element is molded synthetic resin.

6. A racket frame in accordance with claim 5 wherein fibers are added to said resin.

7. A racket frame in accordance with claim 3 wherein aid elements are retained by the counter-relief of said grooves.

8. A racket frame in accordance with claim 1 wherein one of said webs is an inside web, taken in relation to the head of the racket, and has two recessed longitudinal grooves, said frame further comprising continuous and pre-formed elements inserted by force into said grooves to increase the rigidity and inertia torque of the head and to regulate its weight by pre-stressing the beam of the frame.

9. A racket frame in accordance with claim 8 wherein another of said webs is an outside web arranged inside of the flanges, and the inside web of said beam is arranged along said flanges, such arrangement thereby increasing the strength of said beam and forming on an outside portion of the beam a cavity which serves as a housing for cylindrical sheaths and which has protection for stringing on the frame.

10. A racket frame in accordance with claim 8 wherein the inside web has edges comprising longitudinal bosses which create an axial cavity, each boss being formed as part of a corresponding flange.

11. A racket frame in accordance with claim 1 wherein joints between the central bow and the head are formed along the entire length of their attachment, two of said joints formed on each side of the head to strengthen the head.

12. A racket frame in accordance with claim 11 wherein two longitudinal parallel ribs attached to and projecting beyond the bow are received by longitudinal grooves in said beam.

13. A racket frame in accordance with claim 11 wherein said central bow includes surfaces which bear against said beam, each of said surfaces including two lateral edges which cooperate with the wall of said beam.

14. A racket frame in accordance with claim 1 wherein said beam comprises walls which have an increased thickness at junctions of the flanges and the webs, one of said webs comprising an inside web and having a greater thickness than the other of said webs which comprises an outside web.

15. A racket frame in accordance with claim 1 wherein said parallel branches are inserted within a longitudinal shell having one open end and one end closed by at least one brace attached to the inside of said branches, said branches cooperating with an external collar, a material being molded within said shell to join said shell to said braches and to dampen vibrations.

16. A racket frame in accordance with claim 15 wherein said brace comprises protecting longitudinal ribs which fit within corresponding grooves on an edge of one of said webs.

17. A racket frame in accordance with claim 15 wherein said brace comprises grooves which cooperate with longitudinal bosses on one of said webs.

18. A racket frame in accordance with claim 15 wherein the material within said shell is a low density synthetic material.

19. A racket frame in accordance with claim 1 wherein the material molded into said beam is a low density synthetic material.

20. A racket frame in accordance with claim 1 wherein said beam comprises bevelled edges which reduce air resistance.

* * * * *

UNITED STATES PATENT AND TRADEMARK OFFICE

CERTIFICATE OF CORRECTION

PATENT NO. : 4,278,251

DATED : July 14, 1981

INVENTOR(S) : Paul LAFOURCADE

It is certified that error appears in the above—identified patent and that said Letters Patent is hereby corrected as shown below:

Column 1, line 17, "made of" should be deleted;
line 22, "operation" should be --operations--;
line 25, --,-- should be inserted after "materials";
line 42, "then" should be --than--;
line 51, "moulded" should be --molded--;
line 66, --both-- should be inserted after "into"; and
line 68, --occur-- should be inserted after "frequently".

Column 2, line 6, "wil" should be --will--;
lines 14-15, "difference" should be --different--;
line 45, "," (first occurrence) should be deleted;
line 51, --,-- should be inserted after each of "5" and frame";
line 52, "edge" should be --edges--;
line 56, --,-- should be inserted after "sheaths"; and
line 62, "the" (second occurrence) should be deleted.

Column 3, line 33, ";" should be --,--;

UNITED STATES PATENT AND TRADEMARK OFFICE

CERTIFICATE OF CORRECTION

PATENT NO. : 4,278,251

DATED : July 14, 1981

INVENTOR(S) : Paul LAFOURCADE

It is certified that error appears in the above—identified patent and that said Letters Patent is hereby corrected as shown below:

Column 3, line 33, "element" should be --elements--;
line 34, "then" should be --them--; and
line 67, --,-- should be inserted after "example".

Column 4, line 21, "string" should be --strings--;
line 21, "he" should be --the--;
line 22, "string" should be --strings--;
line 39, "fiber" should be --fibers--;
line 44, "whhich" should be --which--;
lines 61-62, "neutral surface, thus the" should be deleted;
line 62, --farthest-- should be inserted after "point";
line 62, "thus the" (second occurrence) should be deleted; and
line 63, --and-- should be inserted before "most".

Column 5, line 8, --,-- should be inserted after "apart";
line 12, "positiioned" should be --positioned--;

UNITED STATES PATENT AND TRADEMARK OFFICE

CERTIFICATE OF CORRECTION

PATENT NO. : 4,278,251

DATED : July 14, 1981

INVENTOR(S) : Paul LAFOURCADE

It is certified that error appears in the above—identified patent and that said Letters Patent is hereby corrected as shown below:

Column 5, line 26, --,-- should be inserted after "10"; and
line 64, "moulded" should be --molded--.

Column 6, line 16, --,-- should be inserted after "wall";
line 29, --,-- should be inserted after "stringing";
line 40, "fibres" should be --fibers--;
line 41, "th" should be --the--;
line 49, "end" should be --and--; and
line 56, "a" (second occurrence) should be --at--.

Column 7, line 11, "the" (first occurrence) should be deleted; and
line 57, "aid" should be --said--.

Signed and Sealed this

*Fifteenth* Day of *December 1981*

[SEAL]

*Attest:*

GERALD J. MOSSINGHOFF

*Attesting Officer* *Commissioner of Patents and Trademarks*